US006443805B1

(12) United States Patent
Kirkwood

(10) Patent No.: US 6,443,805 B1
(45) Date of Patent: Sep. 3, 2002

(54) BRA SHELF AND APPLICATION THEREOF

(76) Inventor: Kathleen Kirkwood, 300 E. 85th St., New York, NY (US) 10028

( * ) Notice: Subject to any disclaimer, the term of this patent is extended or adjusted under 35 U.S.C. 154(b) by 0 days.

(21) Appl. No.: 09/501,173

(22) Filed: Feb. 9, 2000

(51) Int. Cl.[7] ..... A41C 3/00

(52) U.S. Cl. ..... 450/31; 450/57

(58) Field of Search ..... 450/57, 30–34, 450/7–11, 60–62, 70, 65, 66; 2/78.1–78.3

(56) References Cited

U.S. PATENT DOCUMENTS

| | | | | | |
|---|---|---|---|---|---|
| 1,750,084 | A | * | 3/1930 | Abrahamson | 450/30 |
| 1,844,888 | A | * | 2/1932 | Lorenz | 450/30 |
| 2,864,373 | A | * | 12/1958 | Buckley | 450/57 |
| 3,297,035 | A | * | 1/1967 | Wright | 450/57 |
| 4,372,320 | A | * | 2/1983 | Silber | 450/30 |
| 4,398,538 | A | * | 8/1983 | Johnson | 450/30 |
| 4,781,650 | A | * | 11/1988 | Budd | 450/55 |
| 4,956,878 | A | * | 9/1990 | Boynton | 450/30 X |
| 5,678,246 | A | * | 10/1997 | Cooley et al. | 450/30 X |

* cited by examiner

*Primary Examiner*—Gloria M. Hale

(57) ABSTRACT

A bra support structure and outer layer garment combination is provided. The Bra support structure, usually constructed of a spandex material, includes a first front chest support panel (1) as the first outermost interior layer thereof and is adjacent to the outer layer garment structure. The bra support structure also includes an second front chest support panel (2). The first and second panels are sewn together and attached to the outer garment layer along each of their side, shoulder and neckline edges. The inner and outer layers of the bra support structure and sewn together around the circumference of the breast area to form pockets which can hold pads to provide additional support and contouring. Different densities and thicknesses of pads can be provided. The bra suuport structure bottom edge is free from the outer garment layer to provide freedom of movement to the wearer. The bra support structure includes two triangular back straps formed of a powermesh material and which are centrally attached by a fastener. The side edges of the triangular back straps are attached to the side edges of the other bra support and outer layer garment layers to provide additional support to the wearer.

20 Claims, 21 Drawing Sheets

C

B

A

B

A

BRA SHELF AND APPLICATION THEREOF

FIELD OF THE INVENTION

The present invention relates in general to women's garments and undergarments. More particularly, the present invention relates to a brassiere construction which is particularly suited for integration with an outer garment the combination of which provides support and shape while improving comfort and appearance particularly during active wear. In a preferred embodiment, the brassiere construction allows for customized selection of inserts, e.g., cups, to accommodate an individual's breast asymmetries, including differences in breast size, shape or juxtaposition and provide an enhanced appearance of the breasts when the brassiere is worn under a garment, irrespective of whether the brassiere construction is affixed to the garment.

BACKGROUND OF INVENTION

Brassieres have generally been designed to accommodate substantially symmetrical breasts. Moreover, they are generally designed independently of the garments under which they are worn. Notwithstanding bathing suits, the concept of an integrated brassiere and garment is nevertheless known. For example, U.S. Pat. No. 5,045,018 ("the '018 patent") discloses a camisole having an integrated receiving section for brassiere cups with a stretchable strip affixed in all embodiments of the invention to the base and length of the brassiere cups or, in a preferred embodiment, having a separate stretchable strip sewn to a receiving section of the camisole beneath the cups. Since the cups are attached, they are not understood to be designed to be interchanged with different sized cups. Moreover, the position of the cups cannot be changed to accommodate breasts that are not symmetrically aligned. Furthermore, in the '018 patent the brassiere cups are inserted into a receiving section, the base of which is sewn to the inside of the front of the garment. While such a garment may provide support, the garment and receiving section are likely to move relative to one another, such that in regular active wear the base of the receiving section will tend to ride-up over the breasts and require frequent adjustment of the brassiere element within the garment.

Accordingly, the present invention provides an integrated brassiere (hereinafter "bra") and garment construction that not only provides support and the option of enhancement of the woman's bustline, but also an entirely natural look since the bra element is joined to the garment in such a manner as to permit the front of the garment to move substantially independently of the bra element. Further, since the cups are not attached to each other, they can be individually selected so as to customize the bra, thereby enhancing the comfort of its use as well as the appearance of the bustline.

SUMMARY OF THE INVENTION

While it is a principal object of the present invention to provide an integrated bra and garment construction that minimizes displacement ("riding-up") of the bra within the garment during active wear, the bra construction affords the wearer the opportunity to customize the fit and comfort of the bra as well as appearance created by the bra and hence can be worn without being integrated into, i.e., affixed to, the garment.

It is a further object of the present invention to provide an integrated bra/garment, e.g., of a unitary or one-piece construction, that provides support for the breasts without creating a bulky or puckered appearance. The novel bra construction element of the present invention can be utilized in a variety of garments.

It is yet another object of the present invention to provide a bra/garment construction that can be optionally provided with different styles or sizes of support cups which in turn may be individually positioned to promote comfort and enhance a wearer's figure. Alternatively, the bra construction may be worn without the use of inserts for a more natural appearance.

It is still another object of the present invention to provide a bra construction integrated with garments that can be worn discreetly and comfortably over or in conjunction with a prosthesis by women who have had a partial or full mastectomy.

It is still a further object of the present invention to provide a bra construction that can be used by girls whose breasts have not fully developed to provide a smooth and uniform breast appearance.

These and other objectives are realized in accordance with the present invention. Specifically, a bra or bra-like construction is provided that is comfortable to wear without loss of support, and when integrated with an outer garment gives an entirely smooth natural and uniform appearance to the bustline as observed from the front of the outer garment and is comfortable during active wear, specifically insofar as the bra portion does not "ride-up" and require frequent adjustment. While the bra construction may be integrated into any suitable outer garment, the present invention as further disclosed herein in its integrated configuration will be disclosed in the context of a garment known as a camisole.

In a preferred bra/garment (camisole) embodiment, the bra construction includes a support panel which has front and back portions that are joined together; top and side portions that are joined at their respective edges to the corresponding edges of the camisole (which may also be the inside seam of the camisole) and a bottom portion including a bottom edge that is unattached to the camisole. The support panel further includes stretchable material that is attached to the bottom edge of the support panel or otherwise incorporated into the bottom portion thereof. Specifically, the stretchable material may be an elastic strap, a portion of which is attached to the bottom edge of the support panel and an unattached portion so that the entire strap encircles the body beneath the breasts. In accordance with the present invention, the support panel may be formed with pocket areas into which bra cups or inserts of varying sizes and styles may be interchangeably inserted. The support panel may be constructed from any material, however, it is preferred that the material be compatible, e.g., color compatible, with the material used in the manufacture of the outer garment in order to give a uniformly integrated appearance and to minimize the separate appearance of the bra construction through the outer garment where that objective is considered fashionably desirable. In view of the integration of the bra construction with the camisole, adjustable straps may be incorporated into the camisole, e.g., shoulder straps, that will further enhance the fit of the garment and bra combination.

Further objects, features, advantages and embodiments of the invention will become apparent from the following detailed description taken in conjunction with the accompanying figures showing illustrative embodiments of the invention.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

The present invention is described below in detail with references to the figures which are solely intended as illustrative embodiments thereof. It should be understood that changes and modifications can be made to the disclosed embodiments without departing from the true scope and spirit of the present invention a set forth in the claims following this specification.

DETAILED DESCRIPTION OF THE PREFERRED EMBODIMENTS

Figure 1:
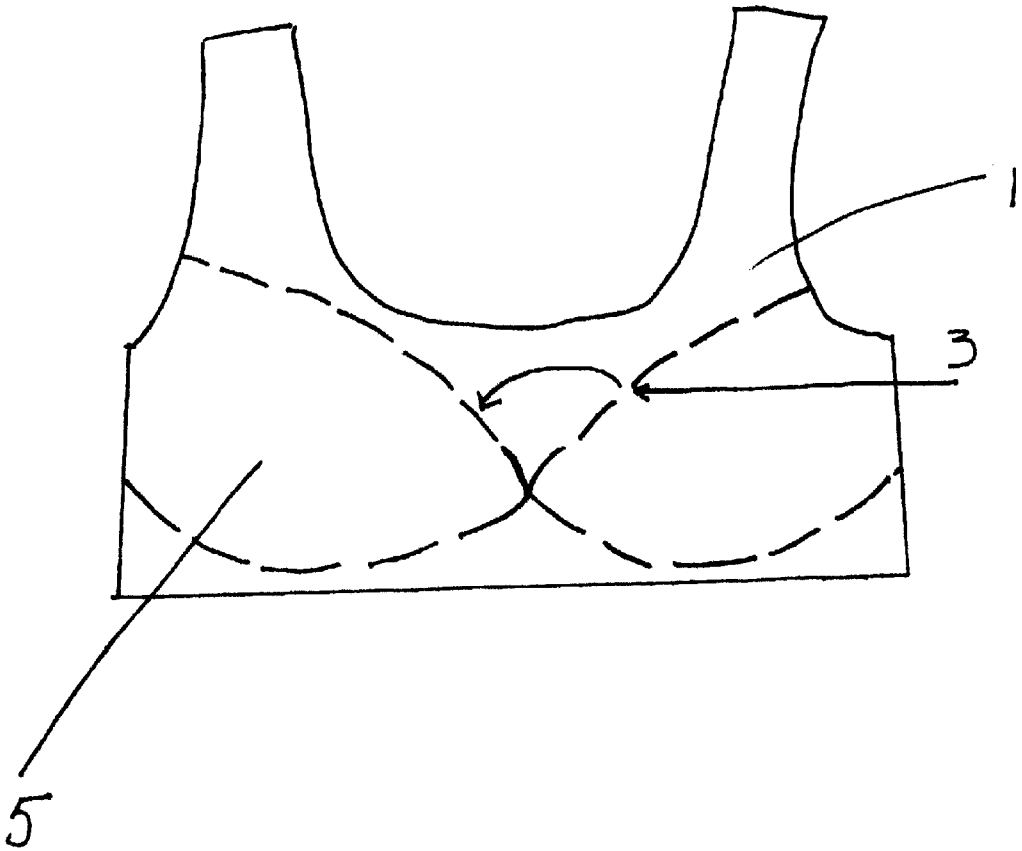
FIG. 1 is a front view of the bra support structure front chest support panel outside layer independent of the outer layer garment structure.
Figure 2:
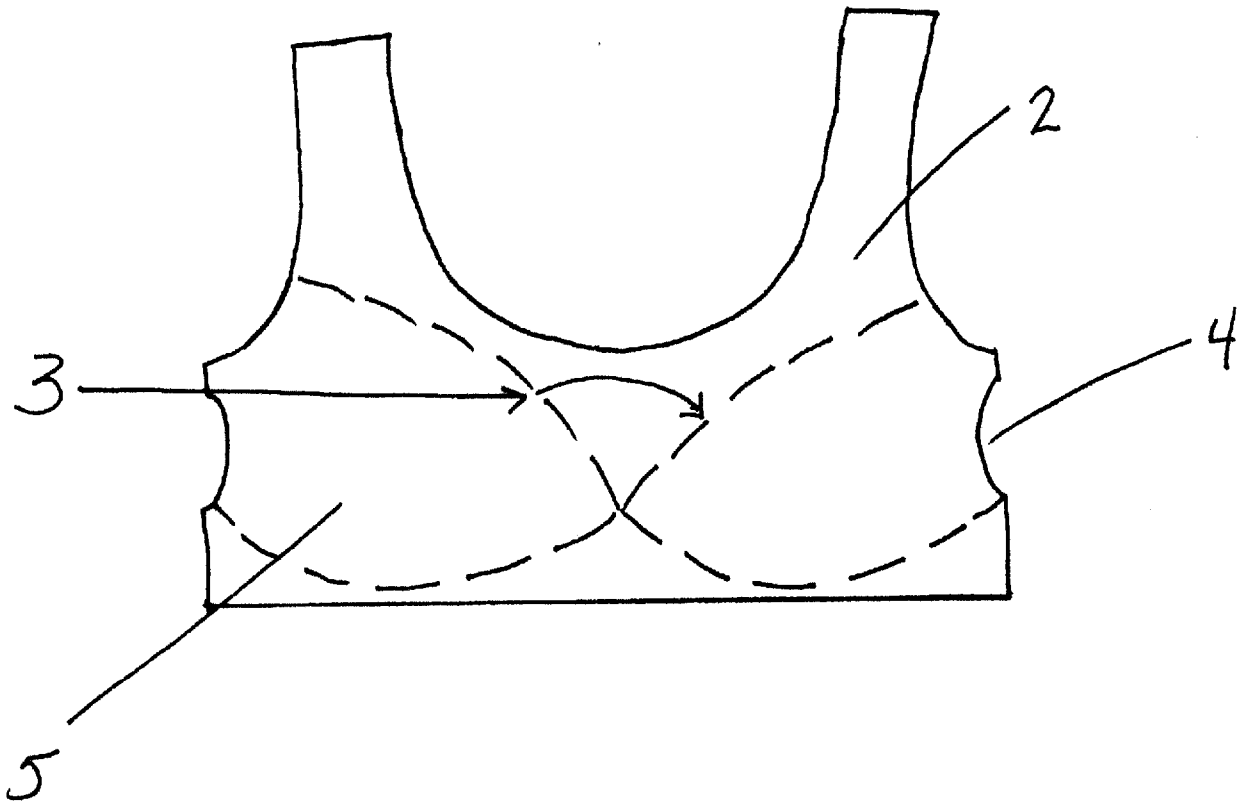
FIG. 2 is a front view of the inside layer of the front chest support panel of the bra support structure.
Figure 3:
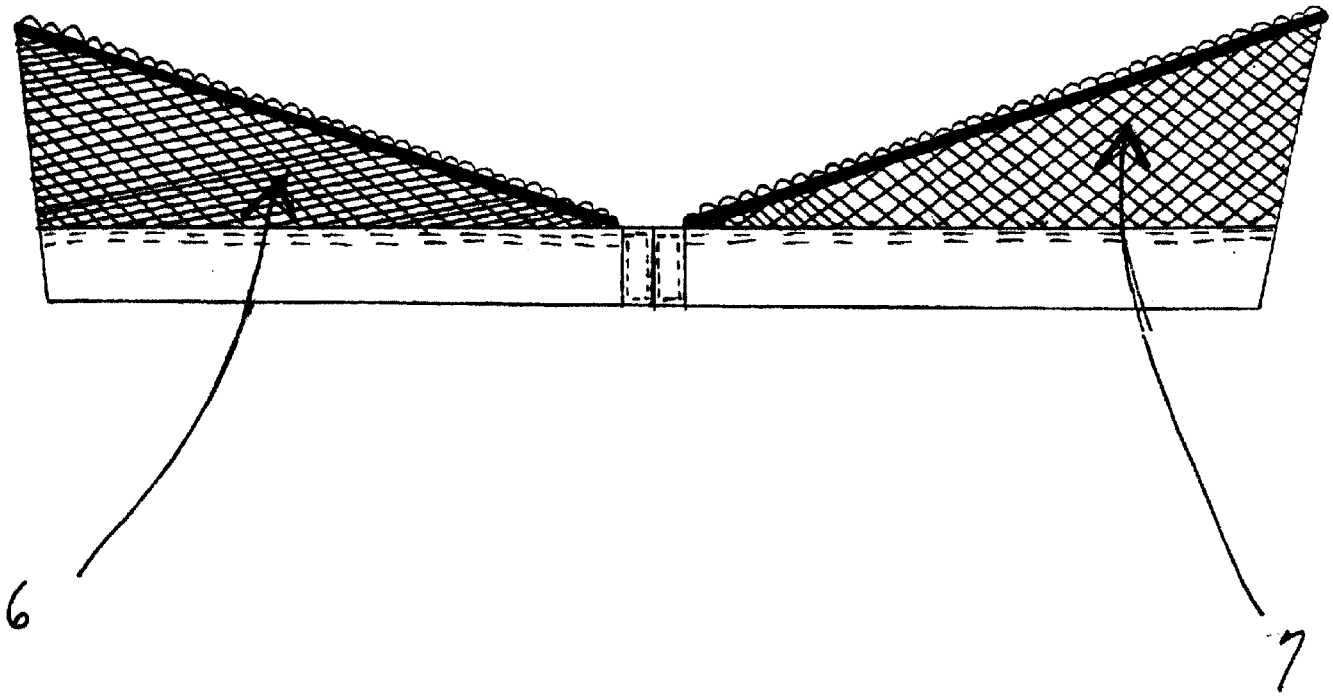
FIG. 3 is a plan view of the two triangular back strap sections.

FIG. 1 shows the bra support structure first front chest support panel (1) which is the first outermost interior layer of the bra support panel structure and which is adjacent to the outer layer garment structure. The front chest support panels are preferably formed of a LYCRA spandex material. The front chest support panel (1) includes sewing line seams (3) around the circumference of each breast area. When the first chest support panel is sewn to the second front chest support panel (2) the sewn seams around the circumference of the breast areas(3) form pockets (5) over each breast area. Each pocket (5) has an access opening (4) along the outer side edges wherein each access opening is under each armpit of the wearer along the side of the wearer's body. FIG. 2 shows the inside or innermost front chest panel layer of the bra support structure which is closest to the chest of the body of the wearer. The curved side of the panels form the pocket access openings when the layers (1) and (2) are attached together. The rear strap structure (as seen in FIG. 3) shows the two triangular straps including a left back strap section (6) and a right back strap section (7). In the top embodiment the front chest panels (1) and (2), as shown in FIGS. 1 and 2, each include a first shoulder edge (8), a neckline edge (12) and a second shoulder edge (9) and two torso side edge seams (11) as seen in FIG. 4*a*. Additionally, the support panels include two side arm seam edges (10) as shown in FIG. 4*b*. Also shown in FIG. 4*a* is the outer layer garment front (13) and in FIG. 4*b* the outer layer garment back (14) is shown. The attachment of the bra support structure to the outer garment layer structure is accomplished by sewing the corresponding seam edges of the two support front chest panels and the front (13) and rear (14) outer layer garment panels together. Additionally, the two triangular bra support back strap sections are sewn by their torso side edge seams to the torso side edge seams of the front bra support structure and the outer layer garment support structure.

Figure 4:
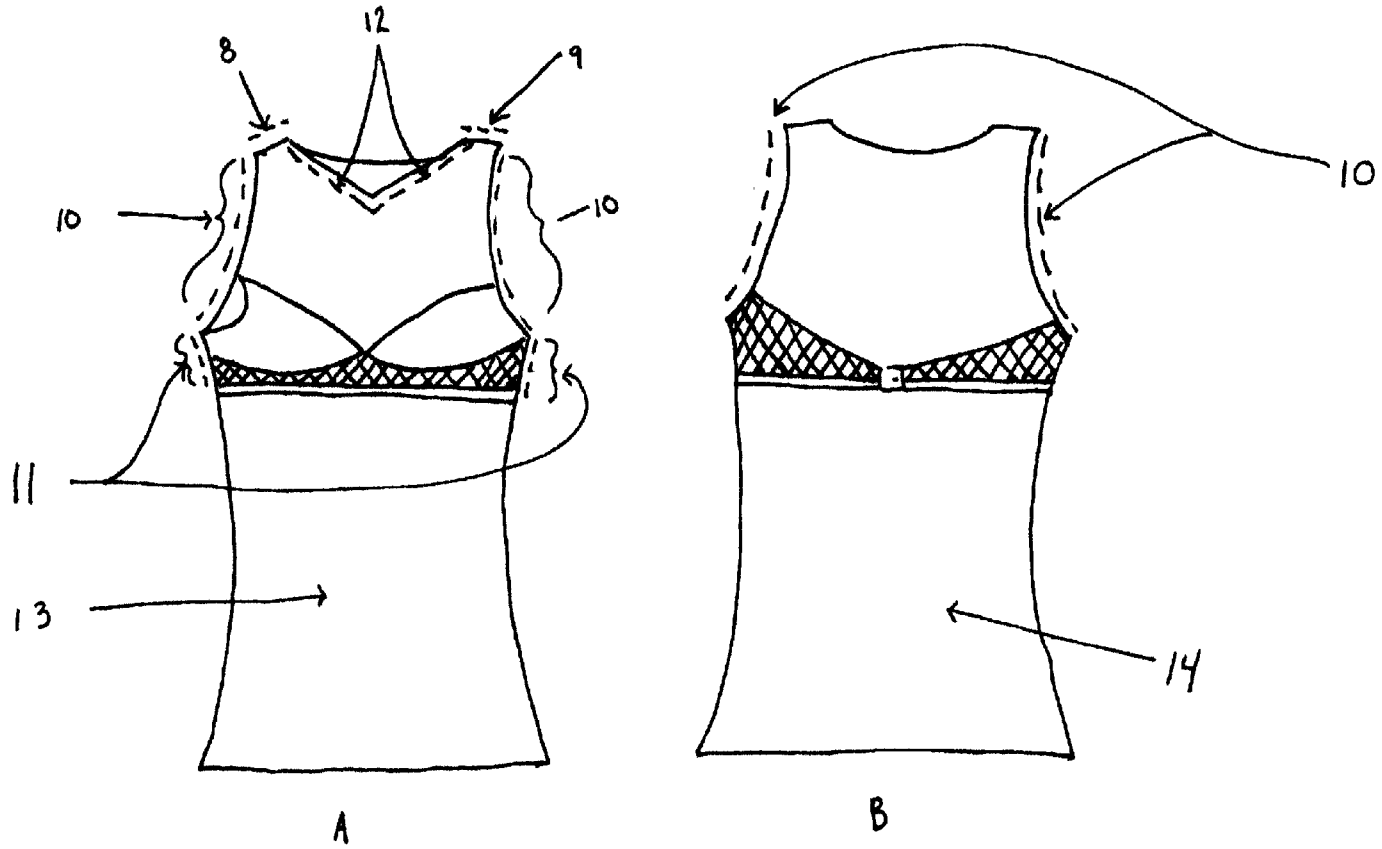
FIG. 4A is a front inside view of the bra support structure and outside garment layer combination showing the attachment of the bra support structure front panels to the outer garment layer structure.
FIG. 4B is a front inside view of the bra support structure and outside garment layer combination showing the attachment of the bra support structure two triangular back support straps to the outer garment layer structure.

The bra support structure two front chest panels and the front outer layer garment panels are sewn along their first shoulder edge (8), neckline (12), second shoulder edge (9), both side arm seam edges (10) and two torso side edge seams (11). The only portion along the sides of the layers left unsewn is along the side torso seam and is the access opening (4) which is the curved portion in the inside layer of the front chest panel. The back panel of the outside garment layer (14) as seen in FIG. 4(*b*) is also sewn to the other panels (1,2, and 13) along the side torso seam edges. The two triangular back strap portions include side torso seams that are also sewn to the side torso seams of the other garment layers.

Figure 5:
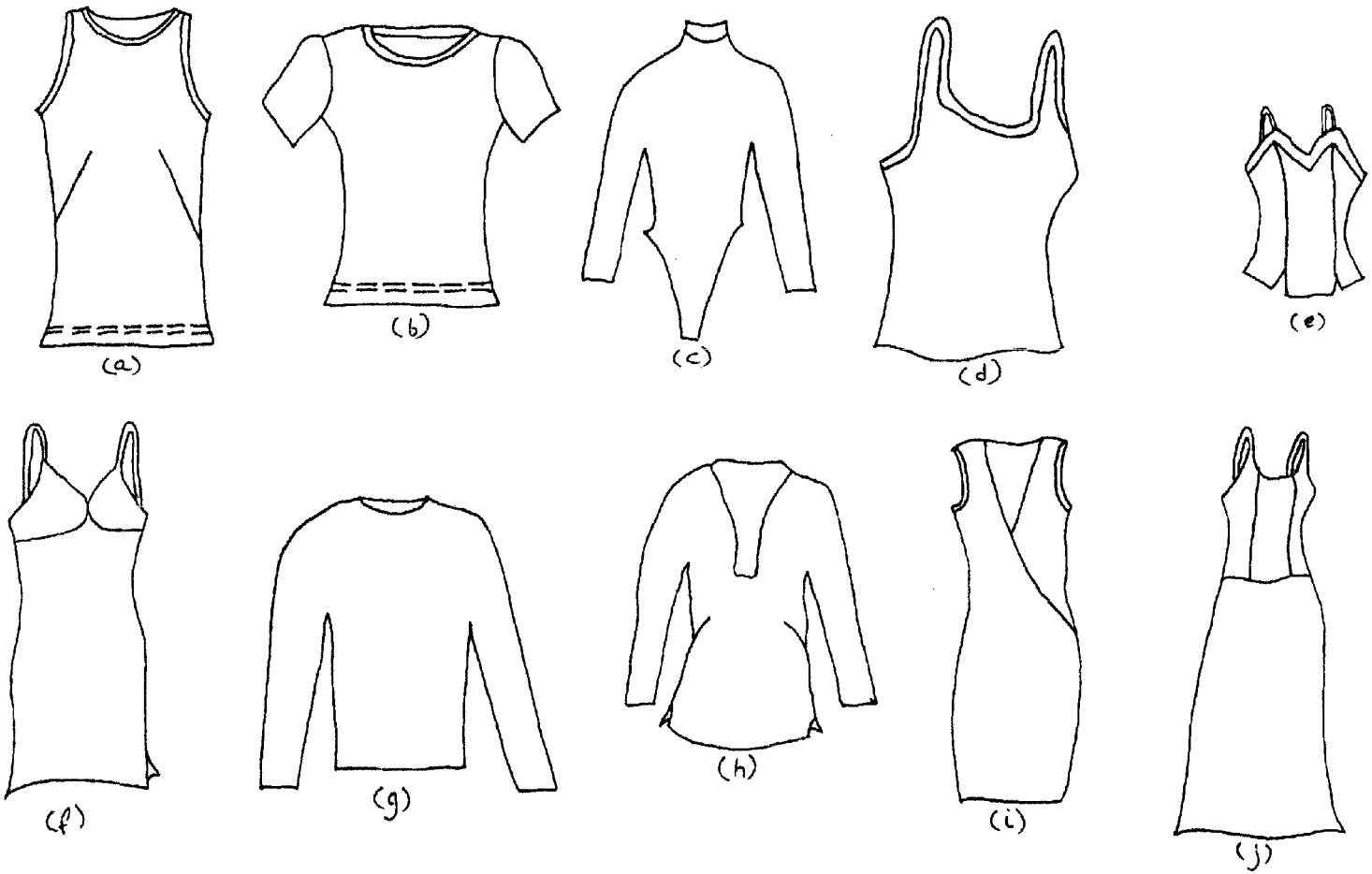
FIG. 5*a* is a front view of a top embodiment of the outer layer garment structure of the present invention.
FIG. 5*b* is a front view of a t-shirt embodiment of the outer layer garment structure of the present invention.
FIG. 5*c* is a front view of a bodysuit embodiment of the outer layer garment structure of the present invention.
FIG. 5*d* is a front view of a swimsuit top embodiment of the outer layer garment structure.
FIG. 5*e* is a front view of a camisole embodiment of the outer layer garment structure of the present invention.
FIG. 5*f* is a front view of a slip embodiment of the outer layer garment structure of the present invention.
FIG. 5*g* is a front view of a pajama top embodiment of the outer layer garment structure of the present invention.
FIG. 5*h* is a front view of a blouse and/or shirt embodiment of the outer layer garment structure of the present invention.
FIG. 5*i* is a front view of a dress embodiment of the outer layer structure of the present invention.
FIG. 5*j* is a front view of a gown embodiment of the outer layer garment structure of the present invention.
Figure 6:
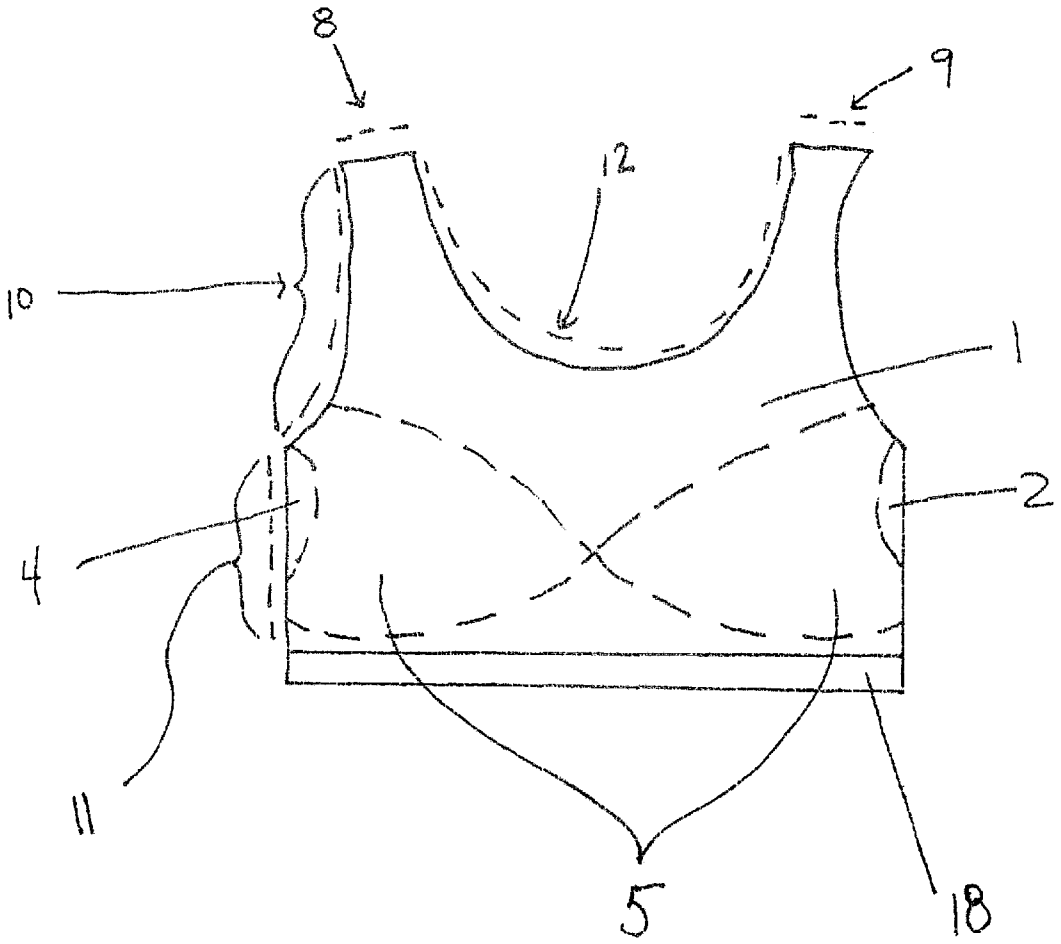
FIG. 6 is a front view of the double layer chest support panel with the pocket seam detail of the dual breast covering pockets with the pocket access openings.
Figure 7:
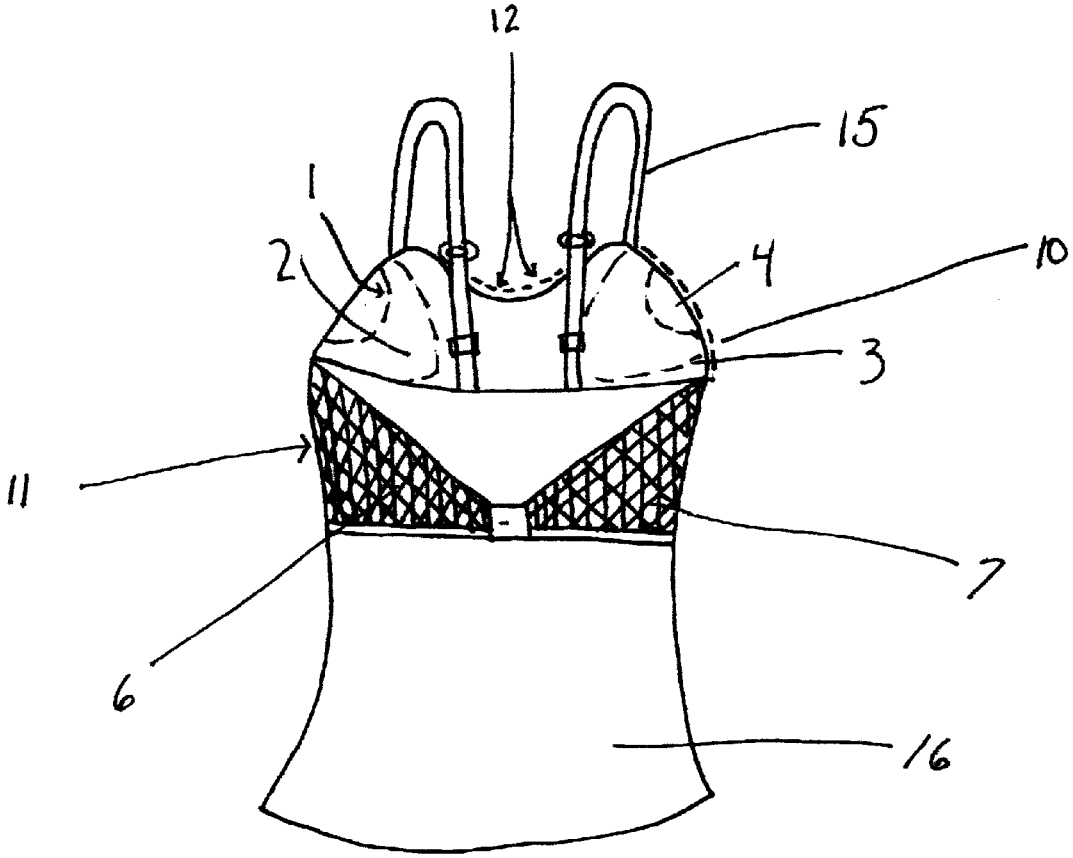
FIG. 7 is an interior view of the camisole embodiment of the bra support structure and outer layer garment combination showing the breast covering pockets formed by stitching the double layer chest panels together about the circumference of the breast and also the breast covering pockets access openings.
Figure 8:
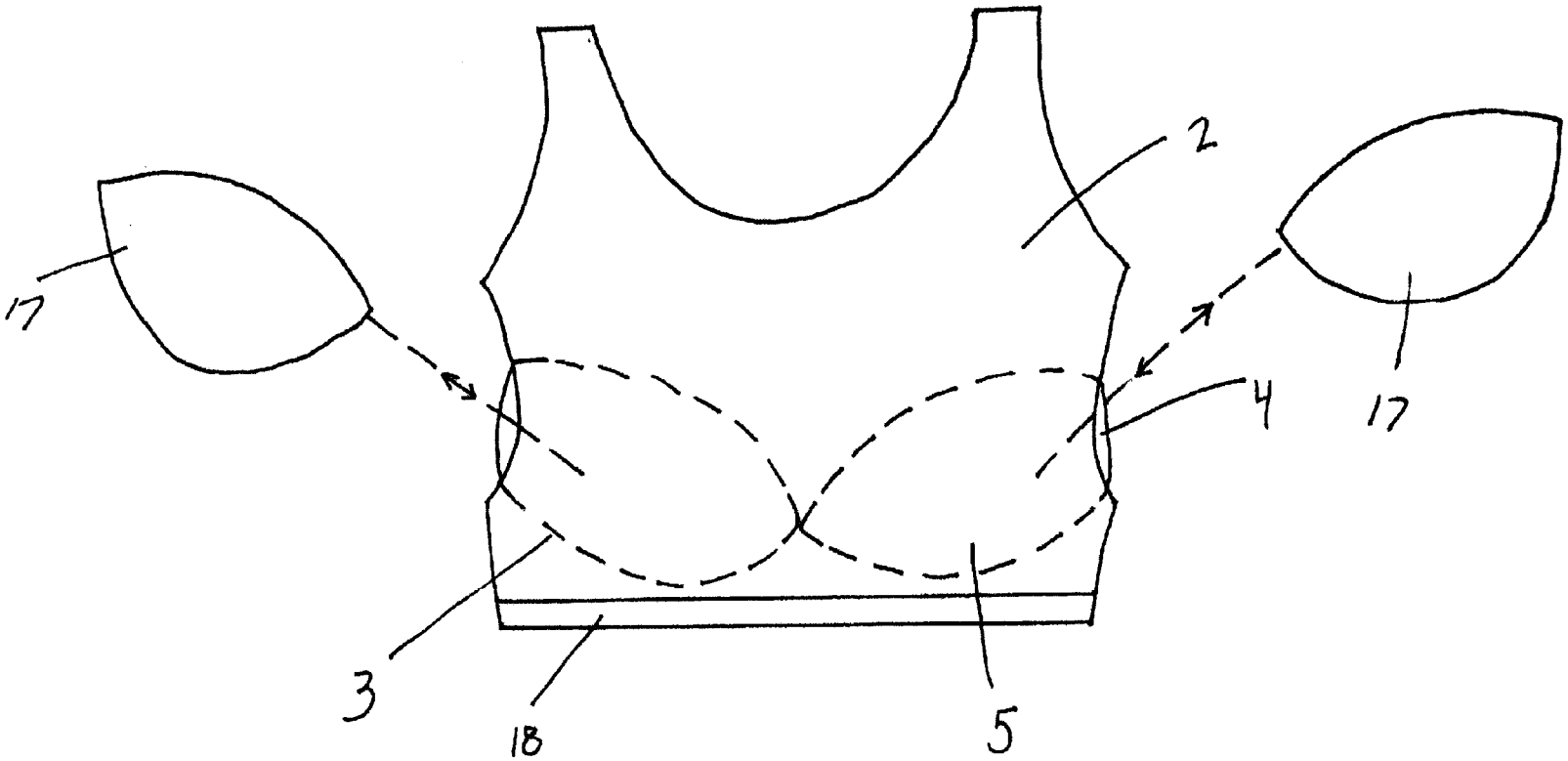
FIG. 8 is an inside view of the double layer bra support structure showing the stitching about the breast area forming the pockets with access openings and removable bra pads for insertion therein.
Figure 9:
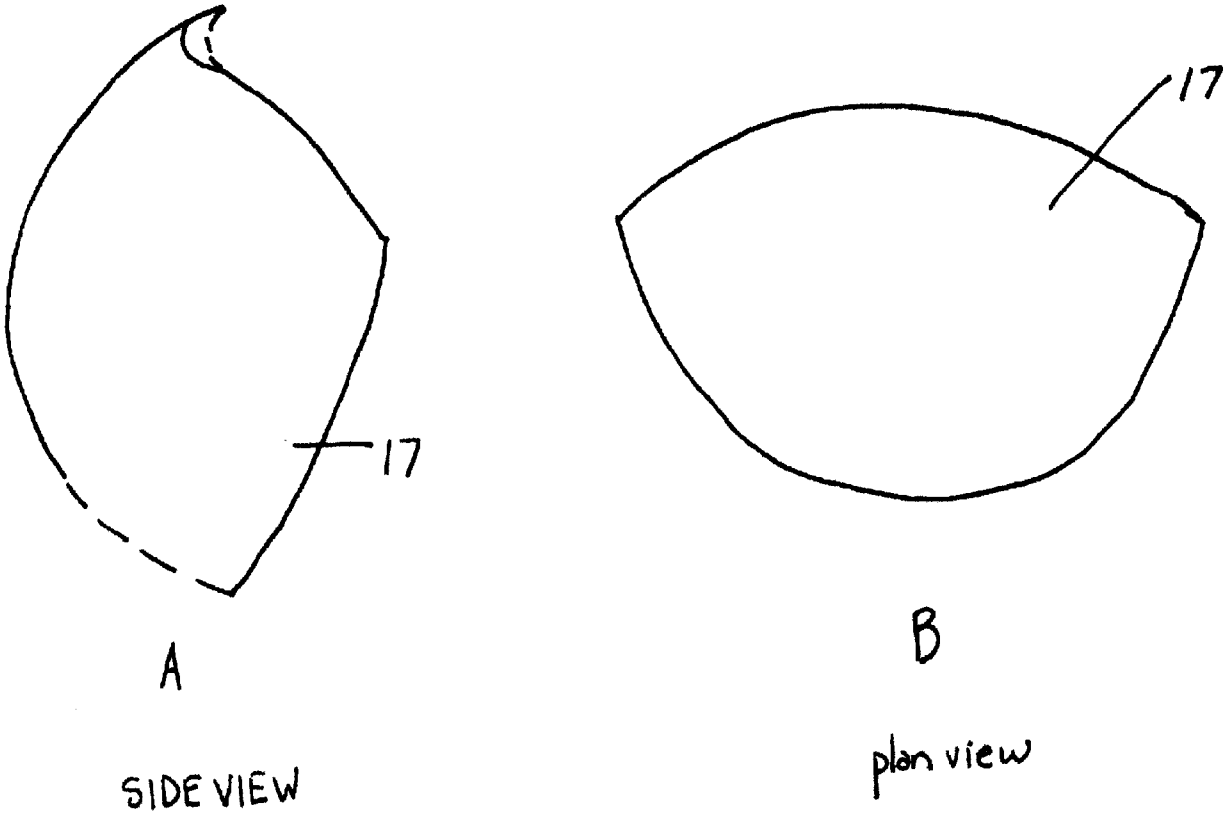
FIG. 9A is a bra pad three-dimensional side view.
FIG. 9B is a plan view of the pad front showing the convex upper edge and the concave lower edge.
Figure 10:
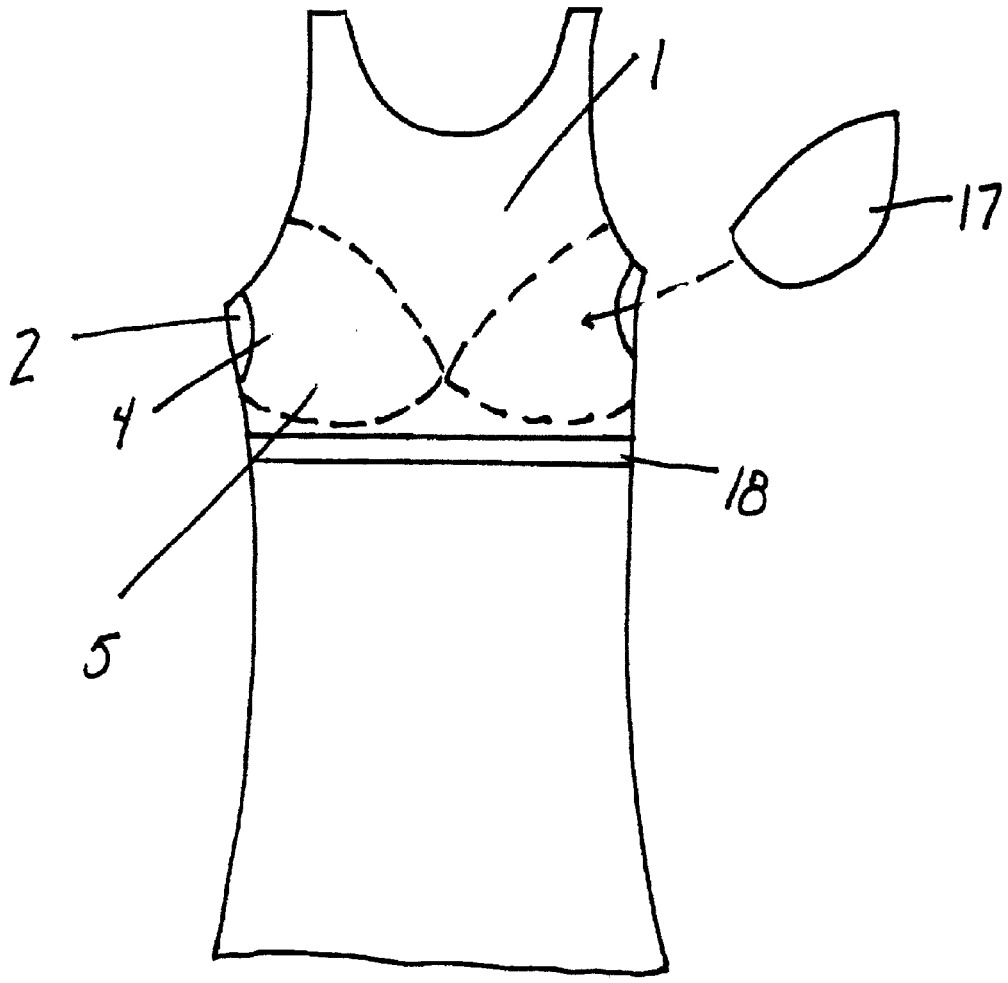
FIG. 10 is an inside view of the bra support and outer layer garment structure combination showing the breast pocket outlines with the pocket access openings and bra pads for insertion within the pockets.

The bra support structure and outer layer garment combination can be constructed including many different types of outer layer garment constructions including a top as seen in FIG. 5*a;* a t-shirt as seen in FIG. 5*b;* a bodysuit as seen in FIG. 5*c;* a swimsuit as seen in figure 5*d;* and a camisole as seen in FIG. 5*e*. Other embodiments include a slip as seen in FIG. 5*f;* a pajama top as seen in FIG. 5*g;* a blouse or shirt as seen in FIG. 5*h;* a dress as seen in FIG. 5*i* and a gown as seen in FIG. 5*j*. In detail, the double layer chest support structure, as seen in FIG. 6 shows the double layer structure including the first chest support panel (1) and the second chest support panel (2) with the access opening (4) for access to the dual breast covering pockets (5) formed by the stitching around the breast areas (3) which attaches the two front chest support panels together to form the pockets (5). The camisole embodiment of FIG. 5*e* is also shown in detail in FIG. 7. The camisole embodiment includes adjustable straps (15) with adjustment mechanisms as commonly used in bra, camisole and slip constructions to provide adjustability to the camisole straps and thereby provides further adjustment to the camisole itself and the exact placement of the breast covering pockets onto the breasts of the wearer as desired. The camisole includes a camisole body (16) and the same neckline edge (12); arm seam edges (10) and torso side seam edges (100) where the two bra support front panels are attached to the front camisole outer layer garment. The back straps (6,7) are structured and attached as in the previous embodiment. The only difference is the camisole embodiment is that it includes spaghetti type straps (15) instead of shoulder seams (8) and (9). Therefore, the camisole embodiment is not attached at the shoulder seams (8 and 9) but rather along the neckline (12) which extends across the top of the camisole to meet the respective side arm edge seams (10). The camisole includes the breast covering pocket (5) formed by the stitching (3) around the circumference of each breast. The pockets (5) are formed for the insertion of pads (17) therein and are shown in FIG. 8. FIG. 8 shows the removable pads (17) which are inserted into the pockets (5) as desired by the wearer. The lower edge of the front bra support panel includes elastic (18) which provides a smooth and secure fit along the bottom of the bra support structure to the wearer's body. The bottom edge is not sewn to the outer layer garment structure front panel 1 and is free to conform to the body of the wearer when the wearer moves about or changes position. The pads (17) are three dimensional in shape and have a convex outer surface and a concave inner surface to be flush against the wearer. The upper edge is convex and the lower edge is concave as seen in FIGS. 9*a* and 9*b*. The pads (17) can be placed into the pockets (5) through the pocket access opening (4) and placed in the pocket at any angle. The pads are shaped to provide the smooth contouring of each breast.

Figure 11:
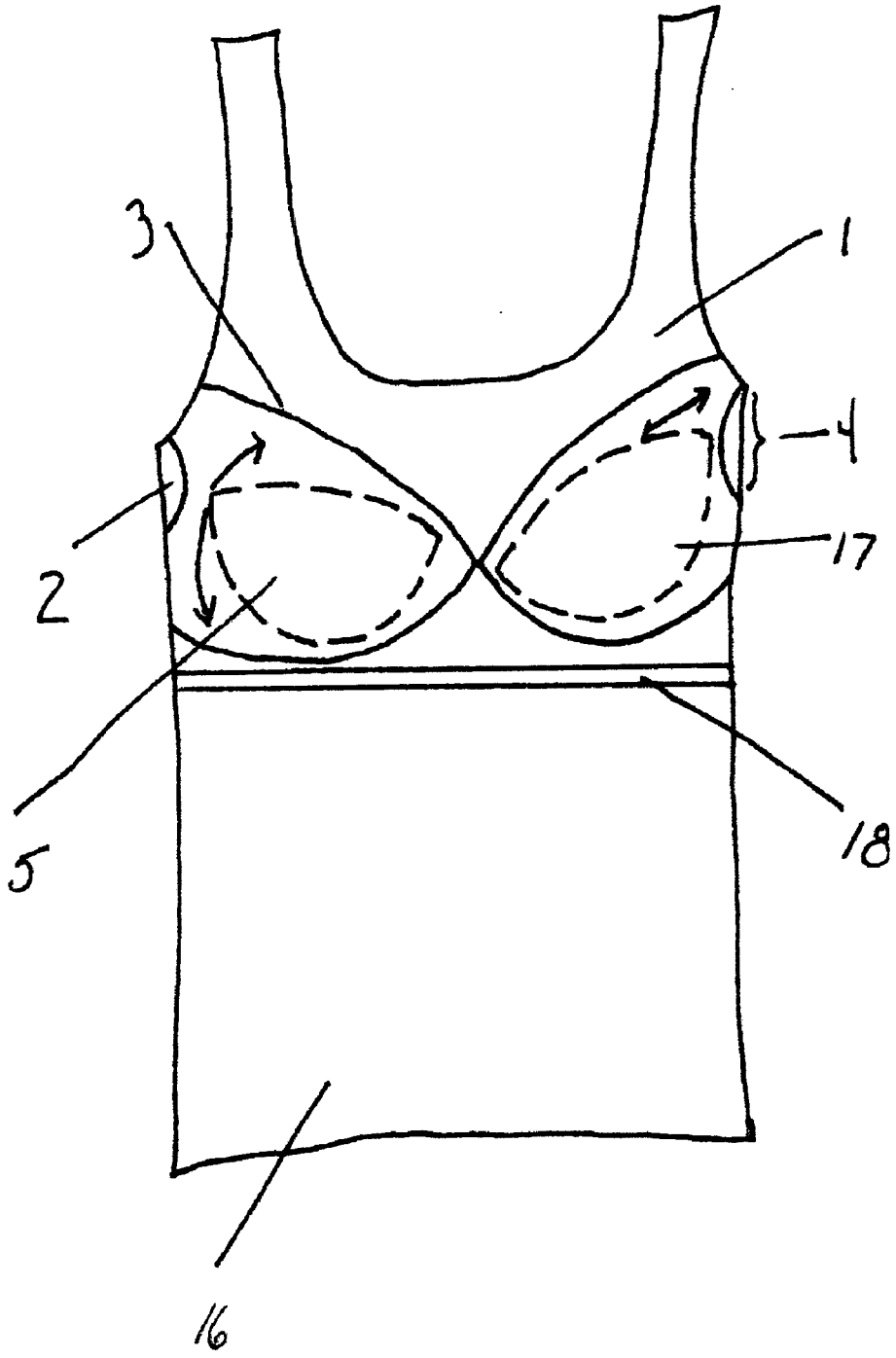
FIG. 11 is a front interior view of the bra support structure and outer layer garment combination showing the breast pocket seam outlines; the pocket access openings and the contouring pads inserted within the pockets with the adjustability of the pads within the pockets.
Figure 12:
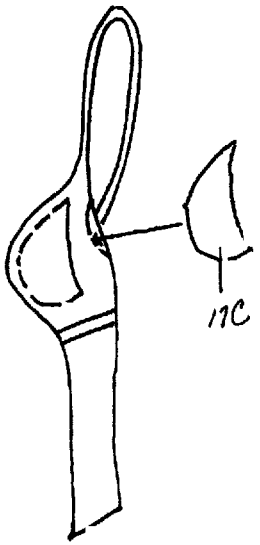
FIG. 12*a* is a side view of the bra support panel and outer layer garment combination with a level 1 pad placed within the pocket.
FIG. 12*b* is a side view of the bra support panel and outer layer garment combination with a level 2 pad placed within the pocket.
FIG. 12*c* is a side view of the bra support panel and outer layer garment combination with a level 3 pad placed within the pocket.
Figure 12:
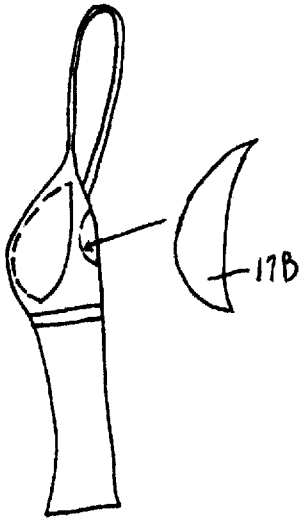
Figure 12:
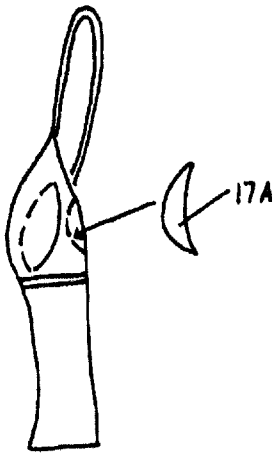

FIG. 11 shows the symmetrical or asymmetrical places ment of the pads (18) into the bra support structure pockets (5). The stitching (3) of the pocket (5) edges is located and structured to form and size the pocket to allow for a range of placement locations. The placement of the pads is only limited by the size of the pocket and the size of the pads inserted in the pockets and the desire of the wearer. The wearer can place the pads (17) in the pockets symmetrically or asymmetrically. They can also place different sized pads in the each pocket or pads of different densities.

The pockets and the pad structures allow for the infinite adjustability and the contouring of the breast at any location from the center of the breast to the side seam of the garment. The pad (17) can move in the pocket (5) up or down, in towards the center of the garment or out towards the side of the garment or diagonally in any direction within the circumferential stitching area (3) about the breast that forms the pocket (5).

Figure 13:
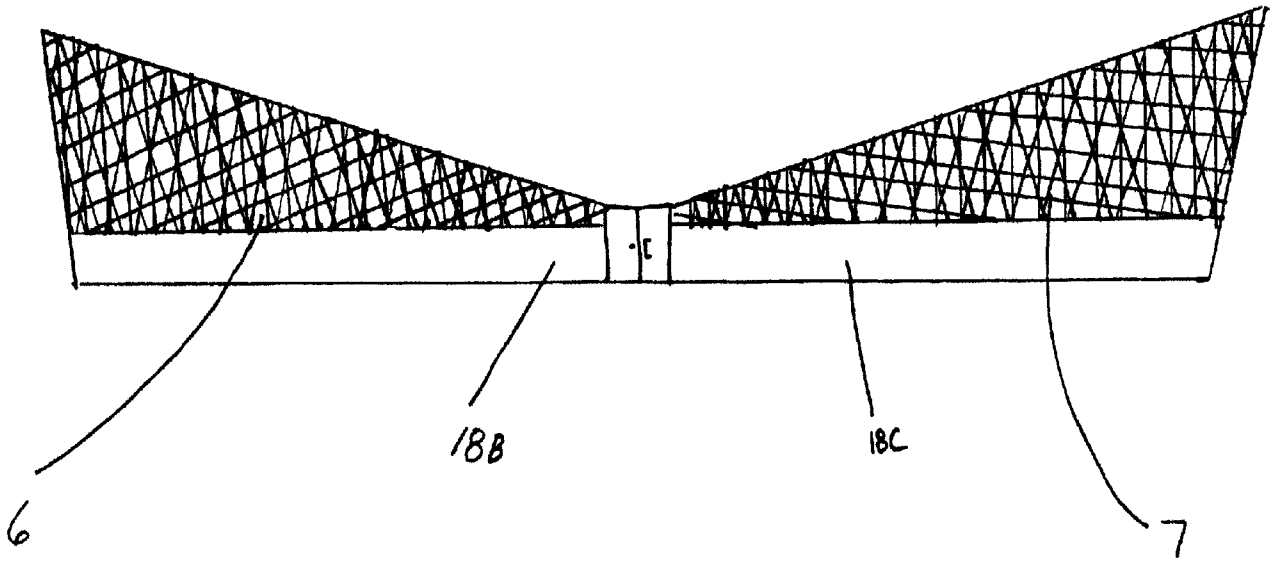
FIG. 13 is a rear view of the bra support structure two triangular back straps formed of a Powermesh material attached together.
Figure 14:
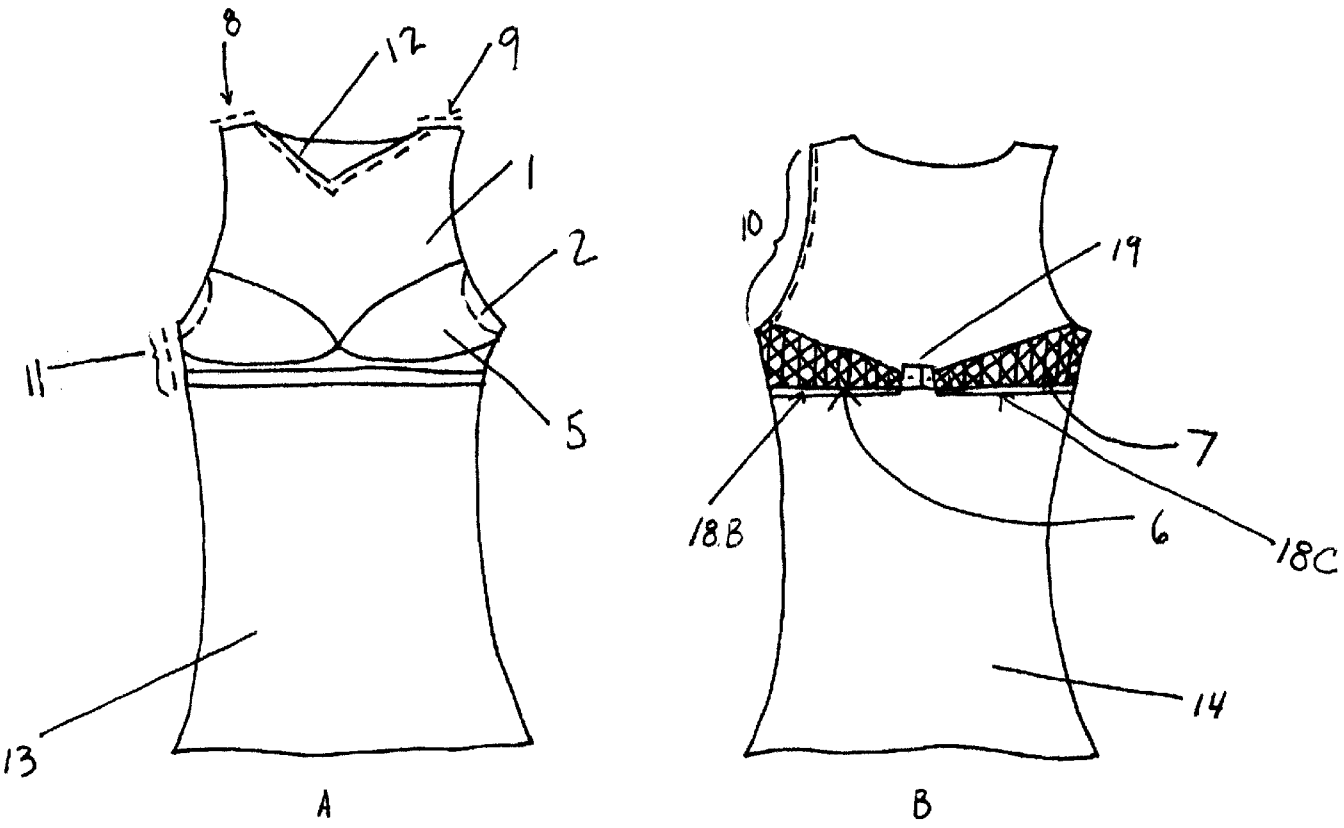
FIG. 14*a* is a front interior view of the bra support structure and outer layer garment combination showing the front panels.
FIG. 14*b* is a back interior view of the bra support structure and outer layer garment combination showing the two triangular back straps.
Figure 15:
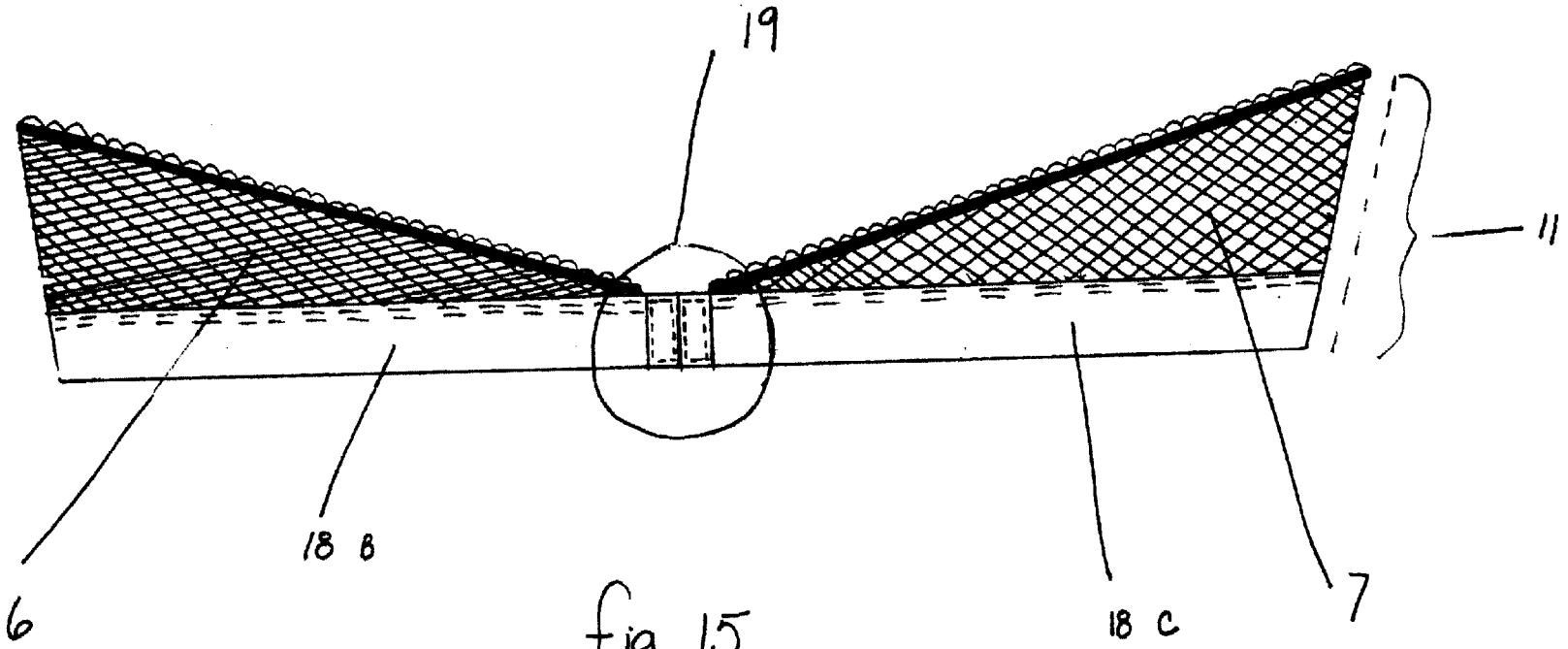
FIG. 15 is a closeup rear view of the two triangular back strap sections joined together by a fastener.
Figure 16:
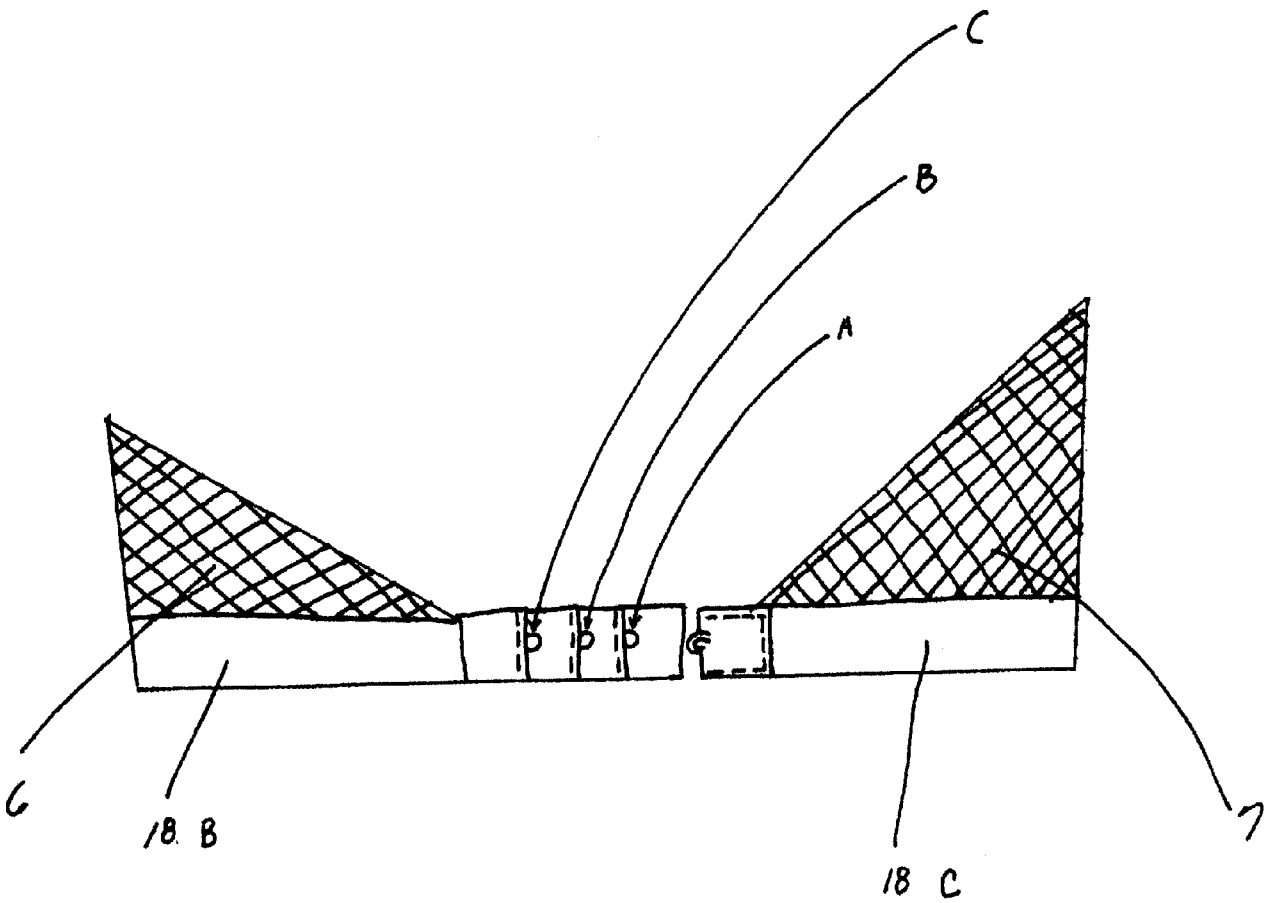
FIG. 16 is a closeup rear view of the two triangular back strap sections joined together by an adjustable fastener.
Figure 17:
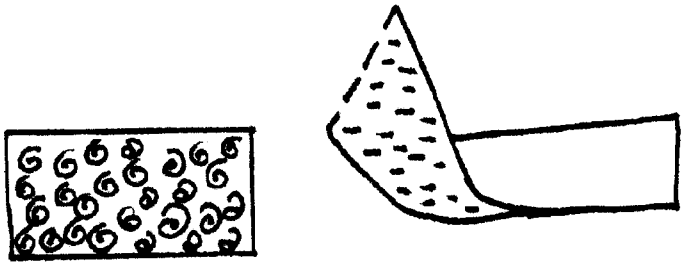
FIG. 17*a* is a closeup rear view of the adjustable rear back strap fastener in the hook and eye form.
FIG. 17*b* is a closeup rear view of the adjustable rear back strap fastener in the hook and loop fastener form.
Figure 17:
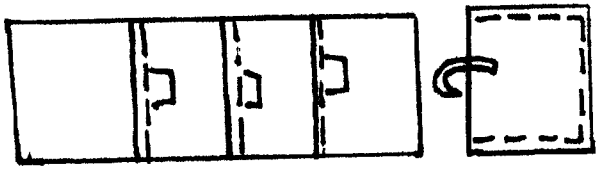
Figure 18:
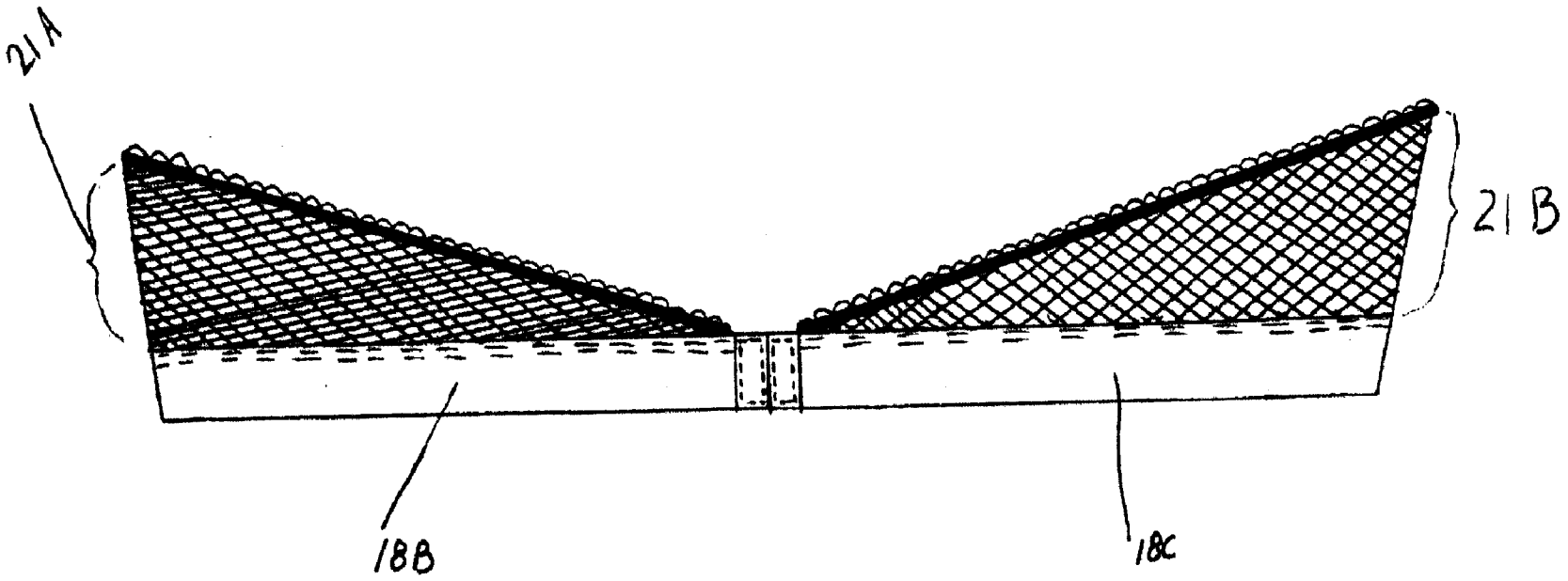
FIG. 18 is a closeup view of the two triangular back strap sections.
Figure 19:
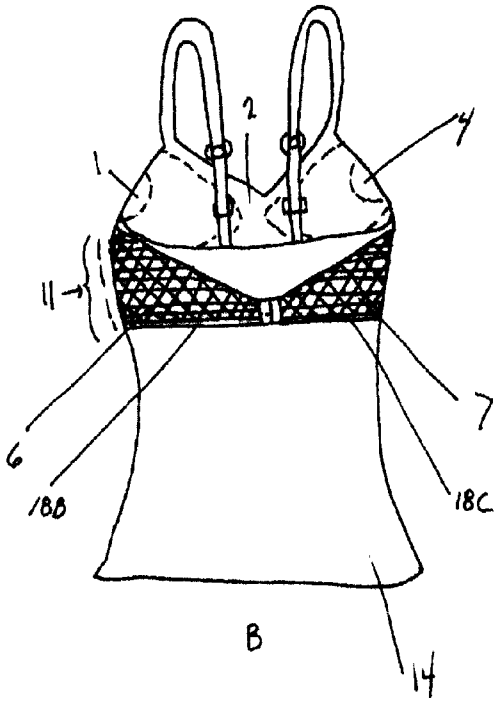
FIG. 19A is an inside front view of the bra support structure and outside garment layer combination.
FIG. 19*b* is an inside back view of the bra support structure and outside garment layer combination.
Figure 19:
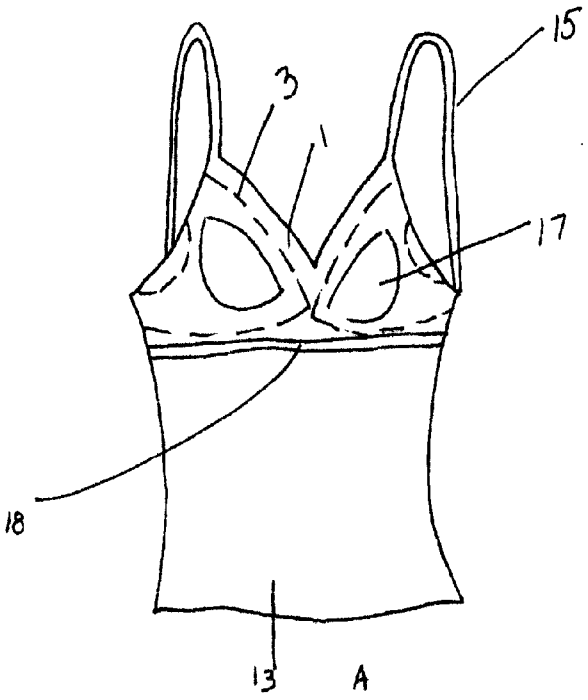

The bra support structure and outer layer garment combination structure includes the adaptability to use a variety of pads (17). The pads (17) can include different levels of contouring and support. A level one pad is a thin pad (17*a*) which provides a slight contour and support; a level two pad (17*b*) is a medium thickness for adding size for a fuller contour and firm support and a level three (17*c*) pad or full thickness pad to augment size and provide altered contour with full support. The pad can be a breast enhancing pad or breast prosthesis. A selection of pads can be provided with the garment for use by the wearer as desired. Each pad can vary in shape, thickness and density to provide various levels of contour and support. The bra pads are preferably full-sized bra cups, as opposed to "half-moon" cups or inserts, which may be made of heat molded microfiber, such as cotton, polyfil or foam, covered by one or more thin panels of jersey tricot or taffeta. The pads (17) can be positioned as required to fit any woman's body irrespective of the shape, size or juxtaposition of the breasts. For example, if a woman is shaped with breasts that are slightly lower or shifted to one side, the support pads can be positioned so as to fit snugly and support the breasts in a comfortable position. Likewise, if a woman has breasts that are positioned closer together and higher, the support pads (17) are positioned accordingly for proper and comfortable support. The bra structure back panels (as seen in FIG. 13 and 14*b*) include a left back support panel and a right back support panel. Each of the left and right back panels are triangular in shape and are formed of a Power mesh material. As seen in FIG. 14*a* the front panel of the bra support structure is constructed of a LYCRA spandex material. The left and right rear triangular back strap portions (6,7) are fastened together with a fastener (19) as seen in FIG. 15. The fastener (19) is a hook and eye fastener which is adjustable as seen in FIG. 16. The hook and eye fastener (19) of FIG. 17*a* includes a hook (d) which is fastened into the desired eye (a,b or c) which provides the different levels of adjustment (a–c) where level a provides a smaller lower edge circumference and c provides for a larger lower edge circumference in the bra support structure. A hook and loop fastener (VELCRO) (20) as seen in FIG. 17*b* can also be used where a loop material (20*a*) fastens to a hook material (20*b*) and which provides infinite adjustability along the length of the hook and loop strap material. The left and right back straps (21*a*) and (21*b*) include a lower elastic band (18*a*) which is further split into two elastic rear band sections (18*b*) and (18*c*) at the fastener. The camisole embodiment of FIG. 19*a* shows the front inside view of the bra support structure and the outer garment layer. The lower elastic edge (18) of the bra support structure is not sewn to the outer garment layer (13). The elastic is only sewn at the side seams (11) along with the two front bra support panels (1) and **(*2) and which are also fastened together by seams along the arm edges (10) and the neckline edge(12)**.

Additionally, the rear bottom elastic edge (18) is also free along its bottom edge from the outer garment rear layer (14). The back elastic bottom edge (18) is sewn to the outer layer garment rear layer (14) only at the side seams. The left rear triangular back strap portion (6) is fastened to the outer layer garment at its torso side seams and the right rear back strap portion (7) is fastened to the outer layer garment at the torso side seam. Both back straps (6 and 7) attach together at the garment rear with a fastener (19).

Figure 20:
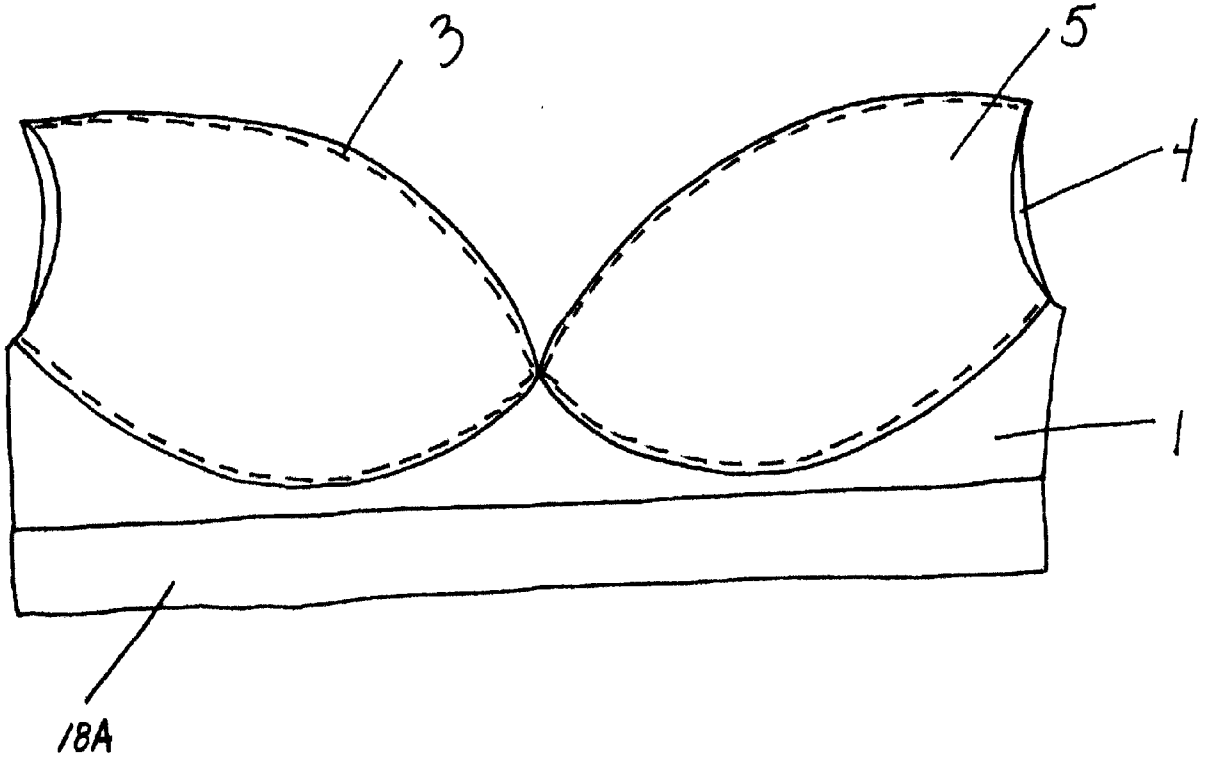
FIG. 20 is a closeup view of the bra support structure front showing the elastic at the lower circumference.

FIG. 20 shows a closeup view of the bra support structure front panel which includes a bottom elastic portion (18)*a* which runs along the entire bottom circumference of the bra support structure to provide a secure fit of the bottom edge of the bra support structure to the body of the wearer while the outer layer garment front and rear panels are looser about the wearer and free from the bottom edge of the bra support structure.

Figure 21:
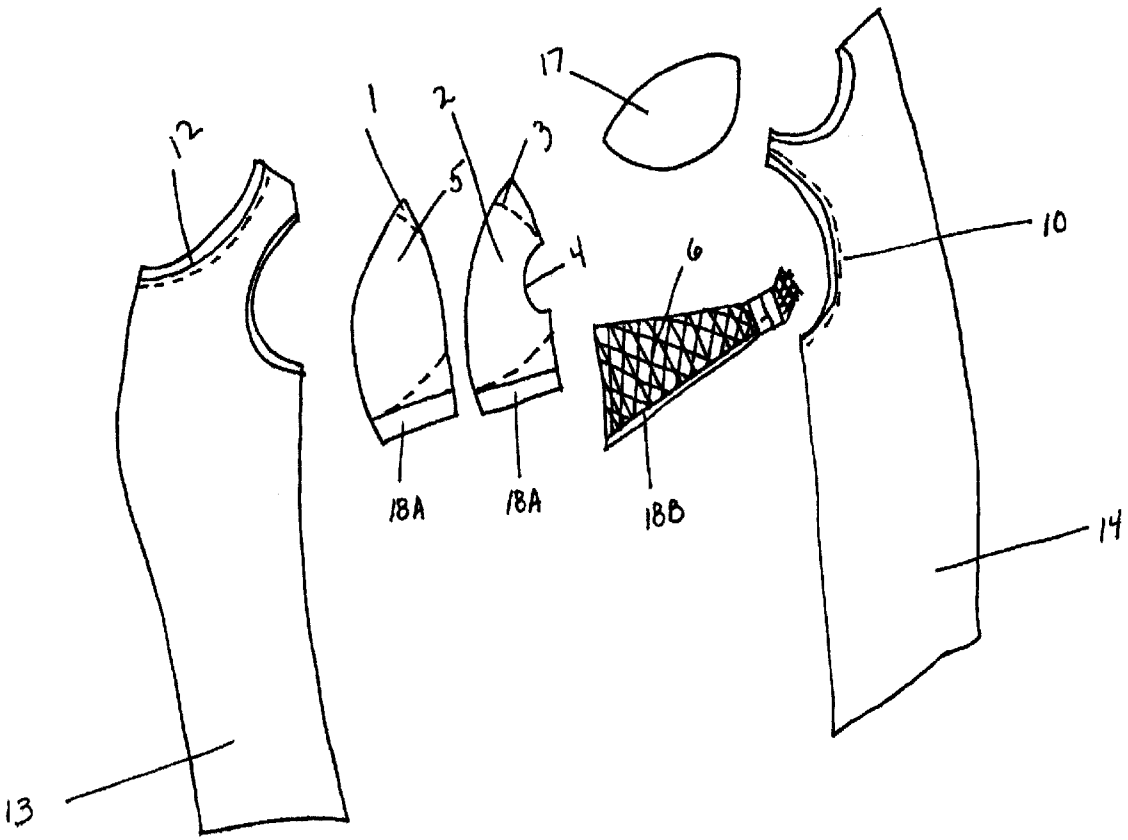
FIG. 21 is an expanded side view of the bra support structure and outer garment layer combination layers.

In conclusion, the main components of the bra support structure and outer layer garment combination are shown in FIG. 21. The front outer layer (13) of the outer layer garment includes a neckline (12) a shoulder seam (9) and arm seam (10). The front support panel outer layer (1) includes an elastic portion (18) at the bottom, the inner bra support layer (2) includes access openings (4). Layers 13, 1 and 2 are sewn together along common neckline, shoulder, arm edge and torso edge seams leaving the access opening (4) open. Additionally, breast pocket stitching (3) around the circumference of each breast is sewn through layers 1 and 2 to form breast pockets (5) over each breast. The access openings (4) allow pads (17) to be placed in each pocket at the discretion of the wearer. The placement of the pad within the pocket is at a location chosen by the wearer and which is limited only by the size of the pockets and the pad. The pad can be placed at any location or position, symmetrically or asymmetrically and provides infinite adjustability within the pocket stitching seams. The back straps (6 and 7) are attached at the side edges to the side seam edges of the other layers of the outer garment (13,14) and the bra support structure (1 and 2). The bra straps are triangular and are attached by a fastener (19) which is adjustable. The back panel is sewn to the other panels at the shoulder seams and the torso side seams. The bra support structure is attached to the outer garment structure only along the top and side edges and is free at the bottom front and back to allow movement of the wearer. This then allows the garment to move freely and not bind or pull the bra structure up on the wearer's body. The pockets and pads provides contouring and support that stays in the appropriate place while allowing for freedom of movement of the wearer.

The bra support structure layers (1) and (2) can also be constructed separate from an outer garment layer and worn alone with the pads to provide contouring and support to the wearer when the bra support structure is integrated into a garment, this arrangement allows the garment to fit softly, smoothly and comfortably over the torso while the bra portion provides support, positioning and shaping for the breasts. The arrangement also enables the garment to move relatively independently of the bra element despite a unitary construction and prevents the bra element from riding-up over the breasts during active wear.

Although the present invention has been described in connection with particular embodiments thereof, it is to be understood that such embodiments are susceptible of modification and variation without departing from the scope of the inventive concept as defined by the appended claims. Furthermore, the bra construction of the present invention as shown in FIG. 1 may be integrated with and used in other garments such as tank tops, tube tops, halter tops, tee-shirts, slips, dresses and athletic wear for providing improved fit and appearance.

What is claimed is:

1. A brassiere support structure in combination with an outer layer garment structure;

said brassiere support structure comprising a front portion having a free bottom edge; two back strap portions each having a free bottom edge;

wherein said outer layer garment structure and said brassiere support structure are joined together at common edges and seams positioned along a wearer's sides, shoulders and neckline and wherein said brassiere support structure front and back portions have unattached bottom edges allowing greater freedom of movement of said outer layer garment while providing contouring and support to the breasts of the wearer.

2. A brassiere support structure and an outer layer garment structure combination as claimed in claim 1 wherein said bra support structure includes a double layer front chest support panel section, a right back strap section and a left back strap section.

3. A brassiere support structure and an outer layer garment structure as claimed in claim 1 wherein said outer layer garment includes a top edge extending from a first shoulder edge across a neckline to a second top shoulder edge; two side arm seam edges and two torso side edge seams;

wherein said bra support panel includes includes a top edge extending from a first shoulder edge across a neckline to a second top shoulder edge; two side arm seam edges and two torso side edge seams and wherein said bra support and said outer garment layer structures are sewn together along said top edge, said two side arm edges and said two torso side edge seams.

4. A bra support structure and outer layer garment structure as claimed in claim 1 wherein said outer layer garment structure is structured in the form of any one of a top, t-shirt, bodysuit, swimsuit, camisole, slip, pajama top, blouse, shirt, jacket, gown, dress or any other upper body torso covering garment.

5. A bra support structure and outer layer garment structure combination as claimed in claim 1, wherein said bra support structure construction includes a double layer chest support panel section with dual breast covering pockets within the double layer construction.

6. A bra support structure and outer layer garment structure combination as claimed in claim 5 wherein said breast covering pockets are each formed by stitching said double layer chest support panel fabric layers together about each breast circumference while leaving an access opening in said pockets along each of said wearer's sides.

7. A breast support structure and outer layer garment structure combination as claimed in claim 6 wherein pads are removably inserted into said pocket.

8. A bra support structure and outer layer garment structure combination as claimed in claim 7 wherein said pad is constructed of any one of a thin, smooth, microfiber, polyfil or foam material.

9. A bra support structure and outer layer garment structure as claimed in claim 7 wherein said pad has a plan view shape with a convex upper edge and concave lower edge and a molded three dimensional convex shape with a convex outer surface to provide smooth contouring of each breast and wherein each pad is placed in any angled position located on each breast and within each of said pockets.

10. A bra support garment and outer layer garment structure as claimed in claim 7 wherein said pockets are formed and sized to allow for the symmetrical or asymmetrical placement of said pads within said pockets to provide for infinite adjustability of the pads and contouring to any desired location over and about each breast and wherein said adjustment of said pad is limited only by the outer edges of said pockets, the size of the pad and the choice of placement by the wearer.

11. A bra support garment and outer layer garment structure combination as claimed in claim 7 wherein a selection of pad pairs are provided which vary in thickness, shape, size and material density to provide various levels of contouring and support.

12. A bra support structure and outer layer garment combination as claimed in claim 2 wherein said back left and right sections are constructed of a power mesh material and said front panel support layers are constructed of spandex.

13. A bra support structure and outer layer garment construction as claimed in claim 12 wherein said outer layer garment construction is formed of any one of spandex, lace, stretch lace, a knit fabric, a woven fabric or any combination thereof.

14. A bra support structure and outer layer garment construction combination as claimed in claim 1 wherein said right and left back panel sections are joined by a fastener.

15. A bra support and outer layer garment construction combination as claimed in claim 14 wherein said fastener is adjustable.

16. A bra support structure nad outer layer garment combination as claimed in claim 15 wherein said adjustable fastener includes any one of a hook and eye fastener or hook and loop fastener.

17. A bra support structure and an outer layer garment structure combination as claimed in claim 2 wherein said left and right back panels are each triangularly shaped.

18. A bra support structure and outer layer garment structure combination as claimed in claim 2 wherein said bra support structure includes a bottom edge which is unattached to said outer layer garment structure and thereby allows greater freedom of movement of said wearer in said garment while allowing the desired support and contouring to the wearer.

19. A bra support structure and outer layer garment structure combination as claimed in claim 1 wherein said bra support structure includes elastic attached at a lower circumference.

20. A brassiere support structure in combination with an outer layer garment structure;

said brassiere support structure comprising a three section construction including a front portion and two back strap portions;

wherein said outer layer garment structure and said brassiere support structure are joined together at common edges and seams positioned along a wearer's sides, shoulders and neckline; wherein said bra support structure includes a double layer chest support panel section with dual breast covering pockets within the double layer construction; wherein said pockets are formed and sized to allow for the symmetrical or asymmetrical placement of contouring pads within said pockets to provide for the infinite adjustability of the pads to any desired location over and about each breast; wherein said adjustment of said pad is limited only by the outer edges of said pockets and the size of the pad in order to provide the desired contouring of the wearer's breasts and wherein said contouring pad placement is at the choice of the wearer.

* * * * *